United States Patent [19]

Habbe

[11] Patent Number: 4,619,203

[45] Date of Patent: Oct. 28, 1986

[54] ARMOR PIERCING SMALL CALIBER PROJECTILE

[75] Inventor: Randall G. Habbe, Pocahantas, Ill.

[73] Assignee: Olin Corporation, Stamford, Conn.

[21] Appl. No.: 727,716

[22] Filed: Apr. 26, 1985

[51] Int. Cl.[4] ..... F42B 11/08
[52] U.S. Cl. ..... 102/516; 102/517
[58] Field of Search ..... 102/510, 514–519, 102/501

[56] References Cited

U.S. PATENT DOCUMENTS 807,375 12/1905 Haase ..... 102/517
4,517,898 5/1985 Davis et al. ..... 102/514

FOREIGN PATENT DOCUMENTS 1578115 4/1971 Fed. Rep. of Germany ..... 102/517

*Primary Examiner*—Harold J. Tudor
*Attorney, Agent, or Firm*—Bruce E. Burdick

[57] ABSTRACT

A small caliber armor-piercing bullet is described in which a case hardened steel nosed lead projectile is utilized to help reduce projectile fragmentation at impact.

1 Claim, 1 Drawing Figure

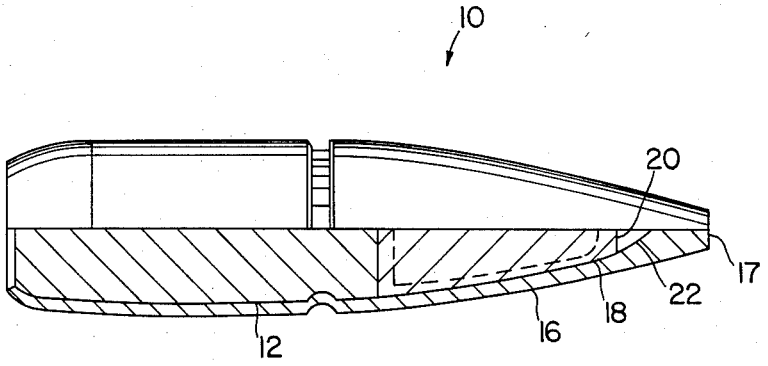
10
20
17
22
18
16
12

ARMOR PIERCING SMALL CALIBER PROJECTILE

The present invention relates to ammunition projectiles and specifically to small caliber armor piercing projectiles.

BACKGROUND AND SUMMARY OF THE INVENTION

In recent years, there has been an increasing tendency toward use by the military services of armored personnel carriers to transport infantry and helicopter gun ships, which are also armored to shoot at infantry. With this increasing use of armor, the rifle bullets of the relatively recent past are, in many cases, rendered relatively ineffective due to their inability to effectively penetrate light armor. Two recent small caliber ammunition (.50 caliber and under) developments have changed the situation somewhat. The first is the reintroduction of the steel nosed lead bullet in such forms as the new NATO 5.56 mm round (called the "M855 by the U.S. Army). The second is the development by Winchester (Olin Corporation) of the first truly effective 7.62 mm and .50 Caliber (12.7 mm) Saboted Light Armor Penetrating rounds. The new Olin SLAP rounds have proven extremely effective while the somewhat rounds have proven extremely effective while the somewhat more inexpensive NATO round has proven to be a significant improvement over the prior 5.56 mm ball round. It would seem that little further could be done to improve the 5.56 mm round, since 5.56 mm is too small to reduce its caliber further to give a saboted round, except perhaps to single flechette, and as yet flechette rifle rounds have all been abandoned as unseccessful.

However, when Winchester attempted to duplicate the M855 round, some unexpected results occured. The Winchester version consistently outperformed the NATO round. In view of this, further experimentation was done to determine the cause of these unexpected results so that the improvements could be introduced into the round. It will be understood that since the M855 round is designed to penetrate armor, the more armor the round can penetrate the better. Thus, surprisingly, a heretofor unrecognized problem was discovered in the existing round and the penetration ability of the round greatly improved.

The improved penetration ability is achieved by the present invention which provides for case hardened steel noses for the round, the hardness of the nose being Rockwell C50 minimum at a depth of 0.030 inches, with the interior of the nose being below Rockwell C50in hardness.

BRIEF DESCRIPTION OF THE DRAWING

The invention will be better understood by reference to the attached FIG. 1, which is an axial cross section of the nose portion of the projectile of the invention.

DETAILED DESCRIPTION OF THE PREFERRED EMBODIMENTS

It is seen that the projectile 10 includes a lead body 12 having its forward portion in a secant ogive, although any other suitable ogive could be used. In front of body 12 is a frustoconical steel insert or nose 18 which has a secant ogival exterior surface and a flat front end 20. Body 12 and insert 18 are encased within a cupronickle 16 which has a pointed tip 17 defining a conical air pocket 22 immediately in front of insert 18 inside of jacket 16. The flat front end of steel insert 18 allows projectile 10 to penetrate armor at greater obliquity than would be the case if steel insert 18 had a pointed nose because the front corners of steel insert 18 can dig into the surface of a metallic target whereas a pointed nose would tend to be deflected.

Steel insert 18 is additionally surface or case hardened to a minimum of Rockwell C50 at a depth of 0.030 inches in order to give the insert increased hardness relative to the armor plates against which it would be expected to be used. For example, standard NATO armor plate has hardness of RB 55-70. Increasing the hardness of the nose portion of a projectile is not something that is lightly done. There is a strong belief, found throughout the prior art, that hardening the nose of a projectile is a bad thing to do because it increases the brittleness of the nose portion which portion sees the highest impact forces as the projectile strikes the target (see for example U.S. Pat. No. 1,398,229). In fact, seen in the test data below, simply hardening the entire nose portion results in projectile fracture on impact. Thus, the basic thrust of the prior art has been to soften the nose portion relative to the remainder of the projectile so that these initial impact forces are cushioned and can be received without breaking the nose of the projectile. However, this makes the projectile nose tend to deform (squash) on impact which reduces sharpness and hence the cutting action (sectional density) of the projectile on impact. Contrary to this belief, applicant has increased the hardness of the nose while leaving the interior of the nose somewhat softer with unexpectedly improved results. In comparative tests against the same armor plates, it has been found that the nose or tip of the relatively softer steel insert of the current M855 round breaks off in test plates and thus increases the frontal area of the projectile so much that penetration is often prevented. In contrast, the case-hardened steel insert of the invention penetrates the same plate without any evidence of deformation of the steel insert. In order to conform the unexpected results of the invention, the following example containing six (6) tests is provided.

EXAMPLE

Samples:

I—E.O. 4443-AISI 12L14 Rc50 min. @0.030" depth, Steel Insert (the invention)

II—E.O. 4443-AISI 4140+Te Rc46-48, Steel Insert (Through Hardened) (conventional 5.56 mm NATO)

III—E.O. 4443-AISI 4140+Te Rc54-57, Steel Insert (Through Hardened) (hardened version II)

Bullet Weights: N=20

| | Weight (grains) | | |
|---|---|---|---|
| Sample | Avg. | Max. | Min. |
| I | 62.0 | 62.3 | 61.6 |
| II | 62.0 | 62.2 | 61.6 |
| III | 62.0 | 62.3 | 61.6 |

Loading Data: All samples

Shellcase—5.56 mm Current Production

Primer—41-257W

Powder—WC844 SM547@26.7 grs.

Bullet—See above

Loaded Length—2.250±0.010 inches

Crimp—Collect four segment

Bullet Pull—140±20 lbs.
Bullet Pull: N=5

| Sample | Pull (lbs.) Avg. | Max. | Min. |
|---|---|---|---|
| I | 143 | 151 | 121 |
| II | 134 | 142 | 126 |
| III | 143 | 156 | 125 |

Results:
Accuracy: Barrel No. Z-10, Range 200 yards, 10 shot groups.

| Sample | Group | Velocity @ 15' (fps) | Accuracy (in.) MR | ES | EV | EH |
|---|---|---|---|---|---|---|
| I | 1 | 3077 | .99 | 2.20 | 2.15 | 2.20 |
| | 2 | 3076 | 1.00 | 3.50 | 2.70 | 3.00 |
| | 3 | 3074 | 1.87+ | 6.85 | 6.30 | 4.75 |
| | 4 | 3075 | .84− | 2.80 | 2.45 | 1.45 |
| | 5 | 3084 | 1.25 | 4.20 | 2.10 | 4.20 |
| | Average | 3077 | 1.19 | 3.91 | 3.14 | 3.12 |
| II | 1 | 3075 | 2.99 | 8.60 | 6.35 | 8.60 |
| | 2 | 3061 | 2.90 | 8.80 | 7.70 | 7.30 |
| | 3 | 3071 | 2.82 | 7.25 | 7.10 | 6.70 |
| | 4 | 3069 | 2.49 | 7.40 | 3.35 | 7.30 |
| | 5 | 3062 | 2.92 | 9.50 | 8.55 | 5.45 |
| | Average | 3068 | 2.82 | 8.31 | 6.61 | 7.07 |
| III | 1 | 3077 | 2.52 | 8.15 | 7.15 | 6.25 |
| | 2 | 3065 | 3.14 | 8.40 | 8.10 | 6.05 |
| | 3 | 3074 | 2.09 | 6.70 | 6.60 | 3.85 |
| | 4 | 3072 | 2.63 | 8.40 | 6.15 | 7.70 |
| | 5 | 3065 | 2.49 | 7.50 | 4.45 | 7.40 |
| | Average | 3071 | 2.57 | 7.83 | 6.49 | 6.25 |

Penetration Tests:
Test No. 1
Plate—0.415" SAE 1020 Hot Roll
Velocity—Muzzle Velocity approximately 3085 fps
Range—100 meters
Gun—Accuracy Barrel Z-10
Results (Continued):
Penetration Tests (Continued):

| Sample | No. of Rds. | Penetration | Comment |
|---|---|---|---|
| I | 10 | 10 - Complete | |
| II | 10 | 0 - Complete<br>3 - Broke back of plate. | Recovered Insert showed front ½ broken away. |
| III | 10 | 3 - Complete<br>5 - Broke through back of plate.<br>1 - Broke back of plate.<br>1 - Incomplete | Recovered Insert showed front ⅓ broken away. |

Test No. 2—Same as 1 but fired in M16A2.

| Sample | No. of Rds. | Penetration | Comment |
|---|---|---|---|
| I | 10 | 10 - Complete | |
| II | 10 | 0 - Complete<br>1 - Broke back of plate.<br>9 - Incomplete | Recovered Insert showed front ½ broken away. |
| III | 10 | 1 - Complete<br>3 - Broke through back of plate.<br>3 - Broke back of plate.<br>3 - Incomplete | Recovered Insert showed front ⅓ broken away. |

-continued

| Sample | No. of Rds. | Penetration | Comment |
|---|---|---|---|

Test No. 3
Plate—Nato Plate Configuration, 10 Ga. (0.138") SAE 1010, 1020, $R_B$ 55-70 and 0.020" Aluminum Witness Plate 6 inches behind.
Velocity—1500 fps
Range—644 meters (simulation)
Gun—Accuracy Barrel No. Z-10
Results (Continued):
Test No. 3 (Continued):

| Sample | Number of Rds. | 15' Velocity | Penetration | Comment |
|---|---|---|---|---|
| I | 10 | 1498 fps | 8/8 - Complete* | 2 shots not counted. Not 1 caliber apart. |
| II | 10 | 1496 fps | ⅝ - Complete*<br>⅜ - Incomplete | 2 shots not counted. Not 1 caliber apart. Recovered Inserts show deformation of front ⅓. |
| III | 10 | 1512 fps | 10 - Complete* | |

*Complete Penetration - Both Plates Perforated.

Test No. 4
Plate—Nato Plate configuration (see above)
Velocity—1300 fps
Range—744 meters (simulation)
Gun—Accuracy Barrel No. Z-10

| Sample | Number of Rds. | 15' Velocity | Penetration | Comment |
|---|---|---|---|---|
| I | 10 | 1325 fps | 10 - Incomplete | Recovered Insert shows no deformation. |
| II | 10 | 1337 fps | 10 - Incomplete | Recovered Insert shows deformation of front portion. |
| III | 10 | 1306 fps | 10 - Incomplete | Recovered Insert shows no deformation. |

Results (Continued):
Test No. 5—Same as 4 but Range 709 meters (simulation).

| Sample | Number of Rds. | 15' Velocity | Penetration | Comment |
|---|---|---|---|---|
| I | 5 | 1325 fps | 5 - Complete* | |
| II | 5 | 1294 fps | 5 - Incomplete | Recovered Insert shows deformation of front portion. |
| III | 5 | 1327 fps | 4 - Complete*<br>1 - Incomplete | No deformation of Insert. |

*Complete Penetration - Both Plates Perforated.

Test No. 6—Same as 4 but Range 714 meters (simulated).

| Sample | Number of Rds. | 15' Velocity | Penetration | Comment |
|---|---|---|---|---|
| I | 4 | 1323 fps | 3 - Complete*<br>1 - Incomplete | No deformation of Insert. |

-continued

| Sample | Number of Rds. | 15' Velocity | Penetration | Comment |
|---|---|---|---|---|
| II | 5 | 1329 fps | 5 - Incomplete | Recovered Insert shows deformation of front portion. |
| III | 5 | 1315 fps | 5 - Incomplete | No deformation of Insert. |

*Complete Penetration - Both Plates Perforated.

What is claimed is:

1. An improved small caliber steel tipped lead projectile intended to penetrate armor, which projectile consists of:

(a) a lead core body portion, (b) a steel nose portion, in front of the body portion, and case hardened to at least Rc50 from its surface to a depth of 0.030 inches and having an interior of a hardness below Rc50, and (c) a bullet jacket about said body and nose portions.

* * * * *